United States Patent [19]

Newington

[11] 4,092,646

[45] May 30, 1978

[54] FLEXIBLE ANTENNA WITH CAPACATIVE PLATE COUPLING

[75] Inventor: Geoffrey Thomas Newington, Portsmouth, England

[73] Assignee: The Marconi Company Limited, Chelmsford, England

[21] Appl. No.: 757,018

[22] Filed: Jan. 5, 1977

[30] Foreign Application Priority Data

Dec. 31, 1975 United Kingdom ..... 53309/75

[51] Int. Cl.[2] ..... H01Q 9/18; H01Q 21/06

[52] U.S. Cl. ..... 343/749; 343/715

[58] Field of Search ..... 343/749–752, 343/745, 802, 895, 715, 711–714

[56] References Cited

U.S. PATENT DOCUMENTS

| | | | |
|---|---|---|---|
| 2,715,184 | 8/1955 | Cork | 343/749 |
| 2,966,679 | 12/1960 | Harris | 343/895 |
| 3,541,554 | 11/1970 | Shirey | 343/715 |

*Primary Examiner*—Alfred E. Smith
*Assistant Examiner*—David K. Moore
*Attorney, Agent, or Firm*—Kirschstein, Kirschstein, Ottinger, Frank & Cobrin

[57] ABSTRACT

A whip antenna is constructed in three sections which screw together end-to-end to form the complete antenna. Each section comprises a flexible fiberglass rod which is surrounded by a sleeve of braided copper wire over a major part of its length, this sleeve serving to pass radio frequency current along the section during use of the antenna. Two of the sections also each provide a capacitor which is connected in the radio frequency path along the antenna. Each of these capacitors is formed by two strips of copper tape which constitute the capacitor electrodes and which lie opposing one another on the surface of the fiberglass rod of the appropriate section.

10 Claims, 3 Drawing Figures

FLEXIBLE ANTENNA WITH CAPACATIVE PLATE COUPLING

This invention relates to radio antennae and is more particularly concerned with whip antennae.

It has previously been proposed to flatten the current distribution along a monopole or other cylindrical antenna by the introduction of capacitors into the radio frequency path along the antenna. This technique is described more fully in an article entitled "Theory of cylindrical antennas with lumped impedance loading" by B. D. Popovic in Radio and Electronic Engineer, Volume 43 at pages 243 to 1248 and in an article entitled "Capacitively loaded thin cylindrical antenna" by B. D. Popovic and M. B. Dragovic in the Proceedings of The Institution of Electrical Engineers, Volume 121 at pages 101 to 108.

There is some difficulty in applying the technique outlined in the above articles to a whip antenna, which is essentially a monopole antenna, due to the inherent lack of rigidity of such an antenna which must be able to flex. One object of the present invention is to provide a novel construction of whip antenna that overcomes this difficulty.

According to the present invention, in a whip antenna, or a section for such an antenna, having an elongated flexible core of electrically insulating material which extends along a major part of the length of the antenna or section and which carries on its surface electrically conducting material to provide the required radio frequency path along the antenna, a capacitor connected in said path is formed by a pair of opposing electrodes that are carried by and embrace said core along part of its length.

The flexible core is preferably a fibreglass rod. The capacitor electrodes may be formed by lengths of copper tape lying longitudinally along the core or by strips of electrically conducting paint applied longitudinally to the core.

One construction of a whip antenna according to the present invention will now be described, by way of example, with reference to the three figures of the accompanying drawings in which FIG. 1 is an elevation view of the complete antenna;

Figure 1:
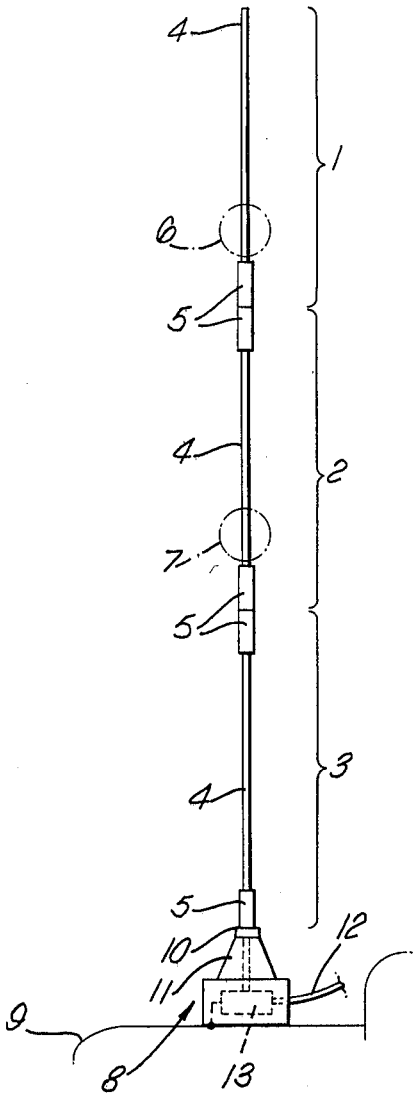

The antenna to be described is for use at frequencies in the region of 30 to 75 megohertz and, referring now to FIG. 1 of the accompanying drawings, is in three sections 1, 2 and 3 which screw together to give a total length of approximately three metres. Each of the sections 1, 2 and 3 comprises a fibreglass rod 4 having a screw-threaded metal ferrule 5 at each end (except at the free end of the section 1). The sections 1, 2 and 3 are screwed together by means of the ferrules 5 and can readily be separated and re-assembled as required. Apart from the circled portions 6 and 7 each of which constitutes a capacitor and which will subsequently be described, the rod 2 of each of the sections 1, 2 and 3 is surrounded by a close-fitting sleeve of braided copper wire (not seen in FIG. 1) which is electrically connected, for example by soldering, to the ferrules 5 to provide the required radio frequency path along the length of the antenna.

In the embodiment under consideration, the complete antenna is mounted on a road vehicle by means of a support assembly 8 secured to the wing 9 of the vehicle. The assembly 8 includes a screw-threaded stud 10 which is carried by an insulator 11 and to which is screwed the ferrule 5 at the bottom of the section 3 of the antenna. This ferrule 5 is connected in known manner to a co-axial feeder 12 by way of an impedance matching unit 13.

Figure 2:
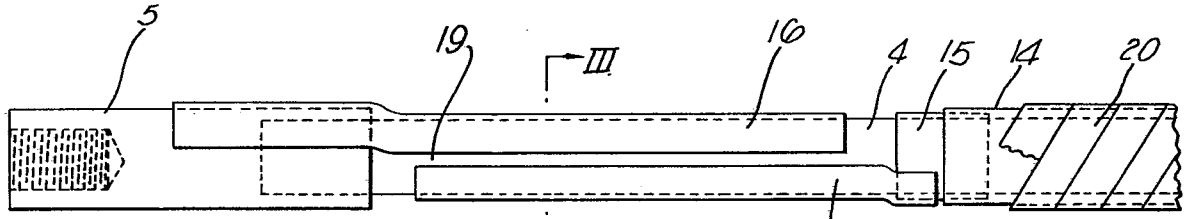
FIG. 2 is an enlarged view of part of FIG. 1.
Figure 3:
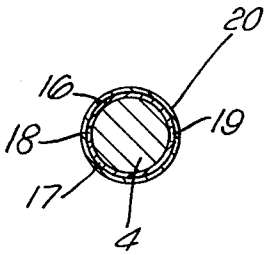
FIG. 3 shows a cross-section at the line III—III in FIG. 2.

The section 2 of the antenna, in particular the circled portion 7 which extends over a length of approximately 0.25 metre, will now be considered in more detail with reference to FIGS. 2 and 3 of the accompanying drawings. The braided sleeve 14 (to which reference has previously been made) extends along the major part of the section 2, and is electrically connected to a tinned copper ring 15 through which the fibreglass rod 4 passes and to which it is secured, the other end of the sleeve 14 being connected to the ferrule 5 (not shown in FIG. 2) at the other end of the sections 2. Said capacitor is provided by means of two lengths of copper tape 16 and 17 of arcuate shape which lie flat on the surface of the fibreglass rod 4 and are secured thereto by suitable adhesive. The two tapes 16 and 17 are of the same width and lie on opposite sides of the fibreglass rod 4 so as to embrace that rod over the major part of the distance between the ferrule 5 and the ring 15 leaving two diametrically opposite slits 18 and 19 between the two tapes, these two slits being parallel to the longitudinal axis of the rod 4. The tape 16 extends over the adjacent ferrule 5 and is electrically connected thereto and the tape 17 extends over and is electrically connected to the ring 15. The capacitor formed by the two tapes 16 and 17 is thus directly connected in the radio frequency path along the antenna.

The capacitor of the circled portion 7 of the section 1 is essentially of the same construction as that just described.

During manufacture, the whole length of the antenna, apart from the ferrules 5, has resin-impregnated fibreglass tape 20 (FIGS. 2 and 3) wound round it and the resin is subsequently cured. In FIG. 2 the tape 20 is shown partially removed to reveal the detail lying under it.

The two capacitors formed in the antenna sections 1 and 2 serve to advance in phase the radio frequency current in the sections 1 and 2 during use so as to increase the radiated field in the horizontal plane. They also have the effect of smoothing the impedance/frequency curve of the complete antenna so as to enable the impedance matching unit 13 approximately to match the antenna to the feeder 12 over the required frequency range without adjustment.

Instead of mounting the whip antenna described above on a vehicle, it may alternatively be mounted on a telescopic mast for use at a greater height above ground. In this case, the antenna is preferably provided with a plurality of rods extending out radially from the base of the antenna to form a counterpose ground plane in known manner.

Although the antenna described by way of example is sectionalised, this is not essential to the invention so that the antenna may alternatively be of unitary form.

I claim:

1. A whip antenna comprising an elongated flexible core which is of electrically insulating material and which extends along a major part of the length of the antenna, electrically conducting flexible material carried on the surface of said core and extending along a major part of the length of the core to provide the required radio frequency path along the antenna, and a capacitor which is connected in said path, and which is formed by a pair of opposed spaced thin electrodes which lie on the surface of, are carrried by and embrace said core along part of its length, one of said electrodes being in electrical contact with an end of said material and the other of said electrodes being out of electrical contact with said one electrode and with said end of said material, the core material constituting the dielectric of said capacitor, said antenna being flexible over the length of the core carrying the material and the electrodes.

2. A whip antenna according to claim 1 wherein said core is fibreglass rod.

3. A whip antenna, according to claim 1, wherein the capacitor electrodes are formed by lengths of copper tape lying longitudinally along the core.

4. A whip antenna according to claim 1 wherein said electrically conducting material is a sleeve of braided copper wire which surrounds the core.

5. A whip antenna according to claim 1 wherein said core is formed in a plurality of sections and there is means detachably to secure said sections to one another to form the complete antenna.

6. A whip antenna comprising a plurality of sections each having an elongated flexible core of electrically insulating material which extends along a major part of the length of the section and which carries on its surface electrically conducting flexible material to provide the required radio frequency path along the antenna, screw-fixing means secured to the cores of said sections to enable the sections to be secured together end-to-end to form the antenna, and at least one of said sections having a capacitor which is connected in said path and which is formed by a pair of opposed spaced thin electrodes which lie in the surface of, are carried by and embrace the core of that section, one of said electrodes being in electrical contact with an end of said material and the other of said electrodes being out of electrical contact with said one electrode and with said end of said material, the material of the core of that section constituting the dielectric of said capacitor, said core sections being flexible over the lengths thereof carrying the material and the electrodes.

7. A whip antenna according to claim 6 wherein said plurality is three and a second capacitor is connected in said ratio frequency path at a point spaced from the previously mentioned capacitor, the second capacitor being formed in the same manner as the previously mentioned capacitor.

8. A section of a whip antenna which comprises a plurality of sections for joining end-to-end to form the antenna, said section comprising an elongated flexible core which is of electrically insulating material, screw-fixing means secured to one end of the core for joining the section to an adjacent section of the complete antenna, a sleeve of braided copper wire surrounding said core over a major part of its length, and a capacitor which is connected between said screwfixing means and said sleeve and which is formed by a pair of opposed spaced thin electrodes which lie in the surface of, are carried by and embrace said core, one of said electrodes being in electrical contact with an end of said sleeve and the other of said electrodes being out of electrical contact with said one electrode and with said end of said sleeve, the material of the core constituting the dielectric of said capacitor, said section being flexible over the lengths thereof carrying the sleeve and the electrodes.

9. A whip antenna comprising an elongated flexible core which is of electrically insulating material and which extends along a major part of the length of the antenna, a sleeve of braided copper wire surrounding said core and extending along the major part of the length of the core to provide the required radio frequency path along the antenna, and a pair of thin electrodes which lie on the surface of said rod over part of its length and which constitutes a capacitor connected in said path, said core constituting the dielectric of the capacitor, said antenna being flexible over the length of the core carrying the sleeve and the capacitor.

10. A whip antenna according to claim 9 wherein said pair of electrodes are each formed by a length of copper tape secured to the surface of said rod.

* * * * *